US005204490A

United States Patent [19]

Soltz et al.

[11] Patent Number: 5,204,490

[45] Date of Patent: Apr. 20, 1993

[54] LASER DIODE APPARATUS FOR INITIATION OF EXPLOSIVE DEVICES

[75] Inventors: Barbara A. Soltz, Spring Valley, N.Y.; Charles R. Chubb, St. Peters, Mo.; John M. Haake, St. Charles, Mo.; Richard G. Podgornik, St. Louis, Mo.; Dale F. Waldo, St. Louis, Mo.

[73] Assignee: McDonnell Douglas Corporation, St. Louis, Mo.

[21] Appl. No.: 719,038

[22] Filed: Jun. 21, 1991

[51] Int. Cl.[5] ..... F42C 19/00

[52] U.S. Cl. ..... 102/201

[58] Field of Search ..... 102/201

[56] References Cited

U.S. PATENT DOCUMENTS

| | | | |
|---|---|---|---|
| 3,362,329 | 1/1968 | Epstein | 102/201 |
| 4,455,941 | 6/1984 | Walker et al. | 102/201 |
| 4,862,802 | 9/1989 | Streifer et al. | 102/201 |
| 4,917,014 | 4/1990 | Loughry et al. | 102/201 |

*Primary Examiner*—Charles T. Jordan

*Attorney, Agent, or Firm*—Benjamin Hudson, Jr.; Guy R. Gosnell; Timothy H. Courson

[57] ABSTRACT

A laser diode apparatus for initiating explosives or other pyrotechnic devices that has capability of checking both the laser diode operation and the optical fiber continuity between the laser diode source and the explosives required to be detonated. Power isolation circuits are provided to control the flow of current to the laser diode, also isolation filters are used to allow only the command signals to initiate the firing circuits employed.

5 Claims, 3 Drawing Sheets

LASER DIODE APPARATUS FOR INITIATION OF EXPLOSIVE DEVICES

BACKGROUND OF THE INVENTION

1. Field of the Invention

This invention relates generally to laser initiation of explosives and other pyrotechnic devices and more particularly to laser diodes for initiating explosive devices that have built-in self check capabilities to check the continuity of the optical circuit and also to provide a safe and arm condition with a device preventing inadvertent ignition of the explosive by the laser. Problems, such as, electrostatic discharges, stray currents, and electrical interference associated with the use of electronic detonators are well documented. As a result, designers have been inclined more and more to utilize laser initiating devices because they have proven to be safer from the hazards associated with electronic detonating devices.

However, even with laser initiating devices, such as the one proposed herein, it would still be desirable if there was a means of checking the continuity of the optical circuit from the laser power source to the explosives. Also, it would be desirable to have a safe and arm feature wherein the laser power source is locked out from initiating a firing sequence prematurely.

SUMMARY OF THE INVENTION

There is provided by this invention a laser diode apparatus for initiating explosives or other pyrotechnic devices that has capability of checking both the laser diode operation and the optical fiber continuity between the laser diode source and the explosives required to be detonated. Power isolation circuits are provided to control the flow of current to the laser diode, also isolation filters are used to allow only the command signals to initiate the firing circuit employed.

DETAILED DESCRIPTION OF THE PREFERRED EMBODIMENT

Figure 1:
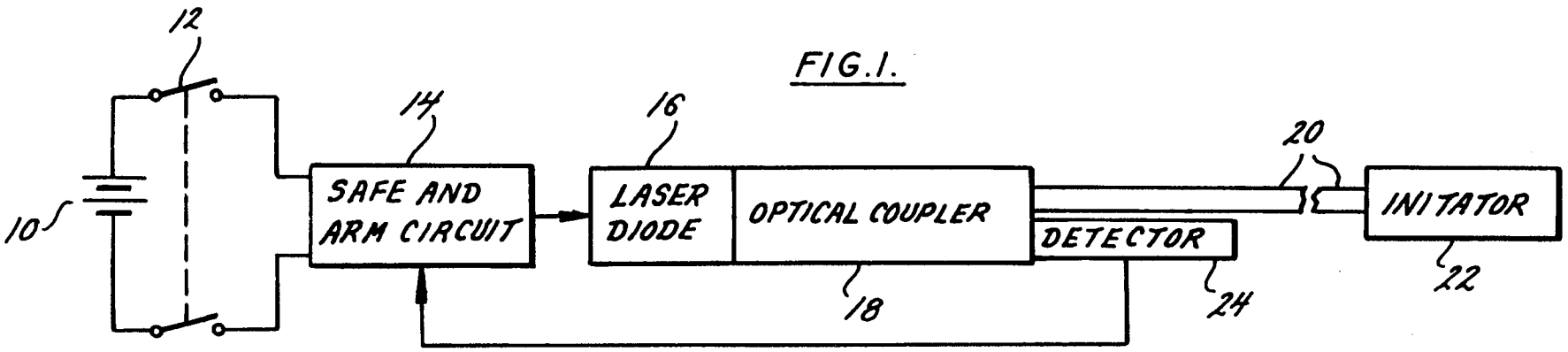
FIG. 1 is a blocked diagram of a laser diode initiating system incorporating the principals of this invention.

Referring to FIG. 1 there is shown a laser diode initiator circuit incorporating the principals of this invention. The circuit is generally comprised of a power supply (10) which supplies power through a switch (12) to a safe and arms circuit (14) which controls the firing of a laser diode (16). The control circuit (14), which will be described hereinafter, generally provides a means for self checking the power source, self checking the laser diode operation, and checking the continuity of the optical circuit to the initiator. The safe and arm circuit initiates the firing of the laser diode (16) through a series of independently operated MOSFETS and isolation filters that allow only the command signal to close the switches, therefore, preventing inadvertent firing of the laser diode (16). The output of the laser diode (16) is coupled by optical devices (18) to an optical fiber (20) that transmits the output of the laser diode to an initiator (22). The optical coupling device (18) may also have means well known to those skilled in the art to receive reflections from the initiator and direct those reflections to a detector (24). This may be accomplished by removing cladding from the fiber (20) so that the detector (24) may receive the back reflections from the initiator (22). The output of the detector (24) is fed back to the safe and arm circuit (14) to provide a monitor of the continuity of the optical circuit. The initiator (22) may be one of several devices well known to those skilled in the art used to detonate explosives or the like in response to the optical energy supplied by the laser diode (16). The initiator may have an explosive mix of Zr-$KCLO_4$.

Figure 2:
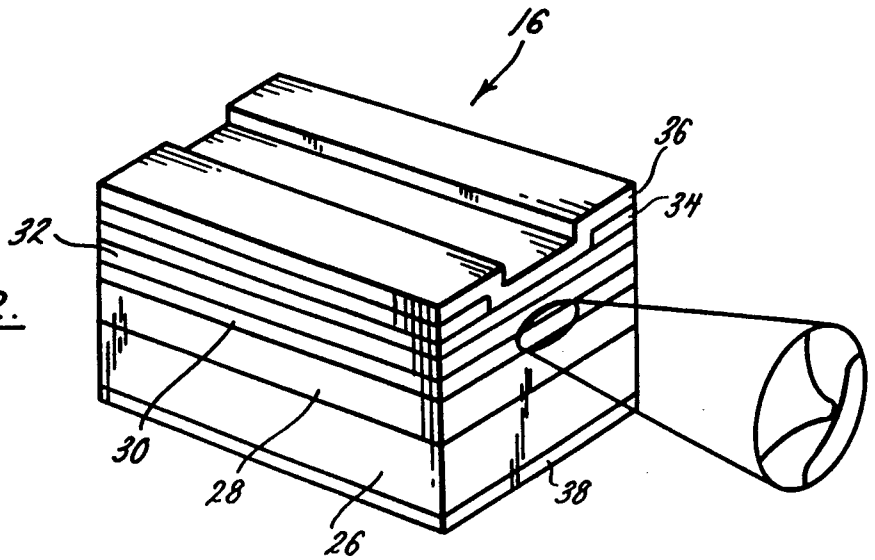
FIG. 2 is a perspective view of a laser diode utilized in the initiating system shown in FIG. 1.

As shown in FIG. 2 the laser diode (16) is a typical laser type semiconductor having an N-substrate (26), an N-cladding layer (28), an active layer (30), a P-cladding layer (32), an oxide cap layer (34) and metallic contacts (36) and (38). The laser diode is initially operated at low power spontaneous emission levels for the light there from to illuminate the initiator but the power is low enough to avoid ignition. The reflected light from the initiator is detected by the detector to indicated whether or not there is continuity in the optical circuit.

Figure 3:
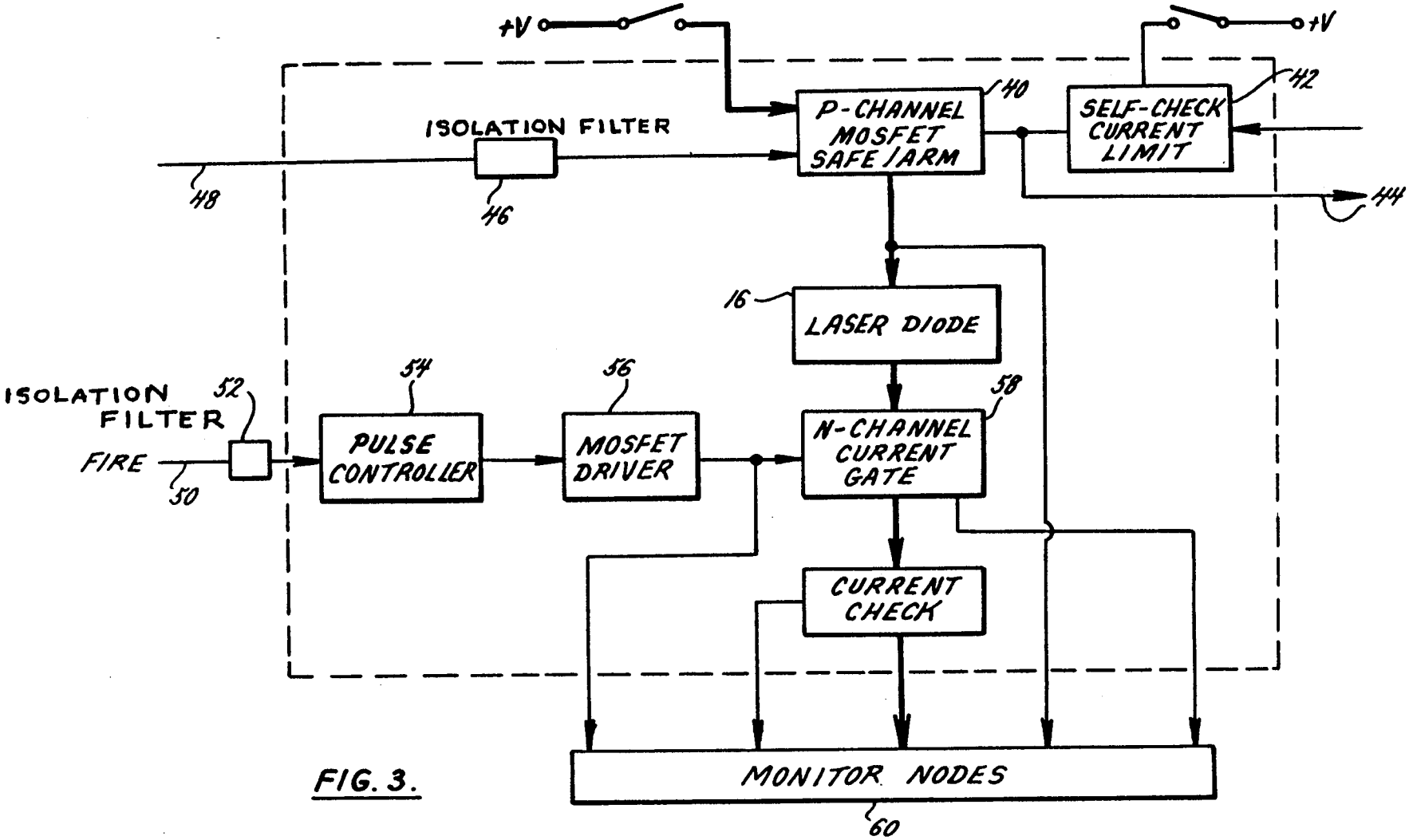
FIG. 3 is a blocked diagram of the electronic safe and arms system utilized in FIG. 1.

Referring to FIG. 3, the electronic safe and arm circuit is shown incorporating the principles of this invention. A MOSFET safe and arm switch (40) controls the application of a firing voltage to the laser diode (16). A self-check current limit switch (42) continuously monitors the ready status of the safe and arm switch (40) via node (44). Control signals to the switch (40) are filtered by isolation filters (46). Signal along the control line (48) serve as prearm or arming commands. The fire command signal (50) is passed through an isolation filter (52) and is processed first by a pulse controller (54) and amplified by a MOSFET driver (56) which activates a current gate (58). Activation of the current gate (58) excites the laser to fire at full power for initiation. Monitor nodes such as shown at (60) provide means to monitor the status of the functions described above.

Figure 4:
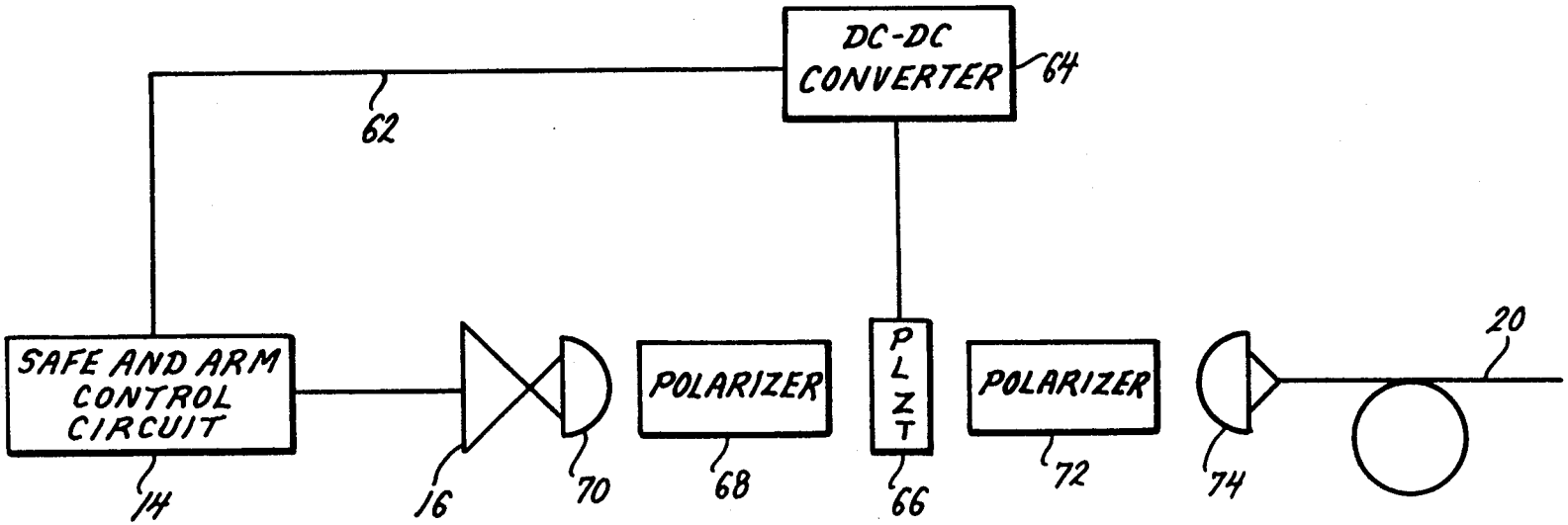
FIG. 4 is a blocked diagram of a laser diode initiating system having an optical safe and arm system.

Referring to FIG. 4 there is shown an optical safe and arm system that may be inserted at the output of the laser diode (16). As the control circuit (14) prepares the laser to fire, a signal (62) is sent to a dc-dc converter (64) to bias a piezoelectric crystal (66). A first polarizer (68) is set to pass the horizontally polarized light collected by the collimating lens (70) from the laser. A high voltage pulse is applied to the crystal (66) to cause the polarization of the input light to rotate by 90 degrees. As the light passes through the crystal (66) the linear polarization is rotated 90 degrees to produce vertically polarized light. A second polarizer (72) will only pass vertically polarized light. Hence the laser light passes through the second polarizer (72) and is refocused by the lens (74) into the optical fiber (20). If no signal is applied to the piezoelectric crystals (66) the light from the first polarizer (68) is not converted from horizontally polarized light to vertically polarized light and thus will not pass through the polarizer (72). This prevents the laser from misfiring since there is no light output to the fiber (20).

Although there has been illustrated and described a specific embodiment, it is clearly understood that the same were merely for purposes of illustration and that changes and modifications may readily be made therein by those skilled in the art without departing from the spirit and scope of this invention.

We claim:

1. Apparatus for laser ignition of explosives, comprising:

a) light means for producing optical energy;

b) optical coupler means for connecting the optical energy to an optical fiber for transmission therethrough;

c) ignition means connected to the optical fiber for receiving the optical energy wherein the ignition means is disposed to ignite an explosive charge at a predetermined optical energy level;

d) electrical control means connected to the light means for generating optical energy at a low threshold power level wherein optical energy is reflected from the ignition means into the optical fiber;

e) detector means connected to the optical coupler means for receiving the reflected optical energy wherein the detector means supplies an input to the electrical control means indicating the status of continuity in the optical circuit;

f) the electrical control means further comprising firing circuits for generating a high threshold power level to ignite the ignition means; and g) polarizing means included in the optical coupler means having piezolectric means for blocking the optical energy in response to the electrical control means.

2. Apparatus for laser ignition of explosives as recited in claim 1 wherein the electrical control means comprises circuits to prearm the light means to a ready state before igniting the ignition means.

3. Apparatus for laser ignition of explosives as recited in claim 2 wherein the electrical control means comprises circuits to energize the light means for firing after the prearm ready state to ignite the ignition means.

4. Apparatus for laser ignition of explosives as recited in claim 3 wherein the electrical control means comprises circuits to monitor the prearm ready state and the firing state of the light means.

5. Apparatus for laser ignition of explosives as recited in claim 3 wherein the light means is comprised of a laser diode.

* * * * *